US009194180B2

(12) United States Patent
Hedley

(10) Patent No.: US 9,194,180 B2
(45) Date of Patent: Nov. 24, 2015

(54) ACCESS DEVICE

(75) Inventor: Robert Ian Hedley, Buttaba (AU)

(73) Assignee: Justoy Pty Ltd, NSW (AU)

( * ) Notice: Subject to any disclaimer, the term of this patent is extended or adjusted under 35 U.S.C. 154(b) by 0 days.

(21) Appl. No.: 13/521,026

(22) PCT Filed: Feb. 16, 2011

(86) PCT No.: PCT/AU2011/000165
§ 371 (c)(1),
(2), (4) Date: Jul. 6, 2012

(87) PCT Pub. No.: WO2011/100793
PCT Pub. Date: Aug. 25, 2011

(65) Prior Publication Data

US 2013/0118832 A1 May 16, 2013

(30) Foreign Application Priority Data

Feb. 17, 2010 (AU) ..... 2010900651

(51) Int. Cl.
*E06C 5/04* (2006.01)
*E06C 5/02* (2006.01)
*E06C 9/08* (2006.01)
*E06C 7/18* (2006.01)

(52) U.S. Cl.
CPC ... *E06C 5/04* (2013.01); *E06C 5/02* (2013.01); *E06C 9/08* (2013.01); *E06C 7/182* (2013.01); *E06C 7/183* (2013.01)

(58) Field of Classification Search
CPC ..... E06C 5/00; E06C 5/02; E06C 5/04; E06C 5/06; E06C 5/24; E06C 5/26
USPC ..... 182/95, 97
See application file for complete search history.

(56) References Cited

U.S. PATENT DOCUMENTS 2,531,263 A * 11/1950 Fink et al. ..... 182/97
2,933,149 A * 4/1960 Royal ..... 182/78
3,556,248 A * 1/1971 Brown et al. ..... 182/15
4,014,486 A 3/1977 Nelson et al.
4,068,770 A * 1/1978 Boehringer ..... 414/537

(Continued)

FOREIGN PATENT DOCUMENTS

AU 738307 * 12/1996
AU 2003200356 A1 8/2003
AU 2008202858 A1 1/2009

*Primary Examiner* — Colleen M Chavchavadze
(74) *Attorney, Agent, or Firm* — Kilpatrick Townsend & Stockton LLP

(57) ABSTRACT

An access device that provides access between a substrate surface and an elevated surface includes a mounting for securing the device below the elevated surface, a first ladder member pivotally attached to the mounting, a second ladder member pivotally attached to the first ladder member, drive mechanism connected between the mounting and the first ladder member, and a guide arm connected between the mounting and the second ladder member to guide movement of the second ladder member as the drive mechanism moves the first ladder member. User operation of the drive mechanism moves the device between an access position, where the first and second ladder members are coaligned and extend angularly outwardly and downwardly from the elevated surface, and a storage position, where the first and second ladder members are retracted and vertically disposed adjacent to the mounting, with the second ladder member inverted relative to the first ladder member.

4 Claims, 9 Drawing Sheets

(56) References Cited

U.S. PATENT DOCUMENTS

| | | | | |
|---|---|---|---|---|
| 5,154,125 | A * | 10/1992 | Renner et al. | 105/447 |
| 6,981,572 | B2 * | 1/2006 | Hedley | 182/95 |
| 7,621,374 | B2 * | 11/2009 | Richey | 182/77 |
| 7,870,932 | B2 * | 1/2011 | Lapke et al. | 182/127 |
| 8,113,314 | B2 * | 2/2012 | Kennedy | 182/84 |
| 8,397,869 | B2 * | 3/2013 | Tsutsumi et al. | 182/127 |
| 2004/0159492 | A1 * | 8/2004 | Hedley et al. | 182/86 |
| 2005/0211502 | A1 * | 9/2005 | LaBrash | 182/127 |
| 2009/0038885 | A1 * | 2/2009 | Ellement | 182/97 |
| 2009/0145692 | A1 * | 6/2009 | Flickinger et al. | 182/127 |
| 2012/0181109 | A1 * | 7/2012 | Rund | 182/97 |
| 2013/0008743 | A1 * | 1/2013 | Hedley | 182/95 |

* cited by examiner

ACCESS DEVICE

BACKGROUND OF THE INVENTION

The present invention relates to an access device, and in particular, to an access device for providing access between a substrate surface and an elevated surface, and which is movable between an access position and a storage position.

The device has a pair of ladder members, which, in the access position, extend generally outwardly and downwardly from the elevated surface. In the storage position, the ladder members are retracted in a substantially vertically disposed manner adjacent a mounting, with one of the ladder members being substantially inverted relative to the first ladder member.

DESCRIPTION OF THE PRIOR ART

The reference in this specification to any prior publication (or information derived from it), or to any matter which is known, is not, and should not be taken as, an acknowledgement or admission or any form of suggestion that prior publication (or information derived from it) or known matter forms part of the common general knowledge in the field of endeavour to which this specification relates.

When it is desired to provide access between a elevated surface, for example on a mine or earth moving equipment or other like vehicle, and a substrate surface, the access device needs to be provided such that in it's stowed position it does not interfere with the normal workings of the vehicle, and, in it's access position it provides easy access between the substrate surface and the elevated surface.

In the access position, the device should be disposed within a certain range of angles to conform with occupational health and safety requirements, the device should be provided with handrails to assist the user when going up or down the device. The preferred range of angles is between 60° and 75°, and perhaps optimally, 62°.

The present invention seeks to provide an access device for providing access between a substrate surface and an elevated surface.

The present invention also seeks to provide an access device which is movable between an access position and a storage position. In the access position, the access device has first and second ladder members which are substantially coaligned and extend angularly outwardly and downwardly from the elevated surface. In the storage position, each of the first and second ladder members are retracted in a substantially vertically disposed manner adjacent the mounting, with the second ladder member being substantially inverted relative to the first ladder member.

In one broad form, the present invention provides an access device adapted to provide access between a substrate surface and an elevated surface, including:

a mounting, for securement of said device below an extremity of said elevated surface;

a first ladder member, a first end of which is pivotally attached to an upper end of said mounting;

a second ladder member, a first end of which is pivotally attached to a second end of said first ladder member;

drive means, operatively connected between said mounting and said first ladder member, to control the movement of said first ladder member between an access position and a storage position; and a guide arm, operatively connected between a lower end of said mounting and said second ladder member, to guide the movement of said second ladder member as said drive means moves said first ladder member;

whereby user operation of said drive means controls the operation of said access device between an access position and a storage position, in which, in said access position, each of said first and second ladder members are substantially coaligned and extend angularly outwardly and downwardly from said elevated surface, and, in said storage position, each of said first and second ladder means are retracted in a substantially vertically disposed manner adjacent to said mounting, said second ladder member being, substantially inverted relative to said first ladder member.

Preferably, said drive means includes:

a rotatable member having three pivotal connectors spaced apart in a triangular arrangement;

a first of said connectors attached to an intermediate portion of said mounting via a mounting arm, a second of said connectors attached to said first ladder member via a control arm; and a third of said connectors attached to an extremity of said mounting via an extendable arm;

whereby, contraction or extension of said extendable arm is effected to thereby cause said rotatable member to rotate about said first connector, to thereby control the movement of said first ladder member, and consequently effect movement of said access device between said access and storage position.

Also preferably, the access device further includes a handrail attached to at least one side of said first ladder member.

Also preferably, said drive means includes a hydraulic, pneumatic or electric cylinder.

Also preferably, in said access position, said ladder members are each disposed at between 60° and 75°, and most preferably at 62°, relative to said substrate surface.

BRIEF DESCRIPTION OF THE DRAWINGS

The present invention will become more fully understood from the following detailed description of preferred but non-limiting embodiments thereof, described in connection with the accompanying drawings wherein.

DETAILED DESCRIPTION OF PREFERRED EMBODIMENTS

Figure 1:
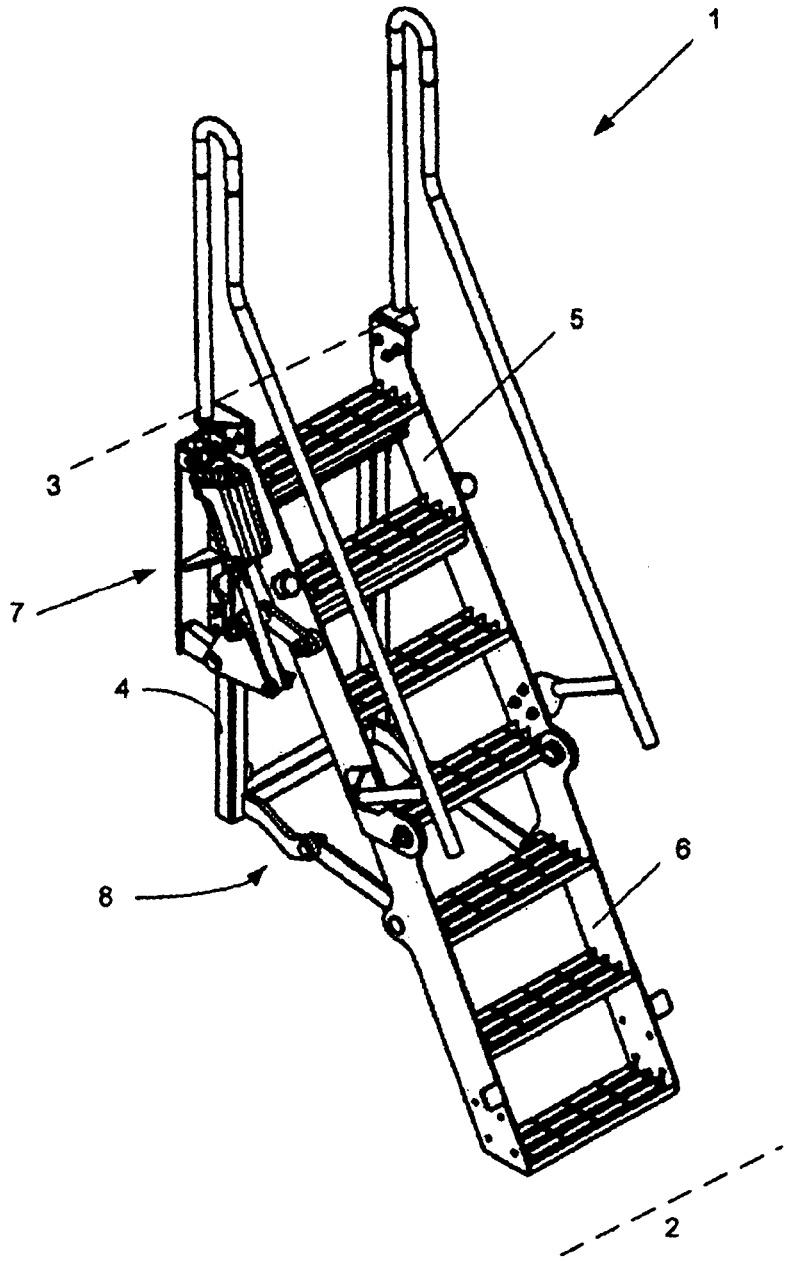
FIG. 1 shows a perspective view of the access device in accordance with a preferred embodiment of the present invention.
Figure 2:
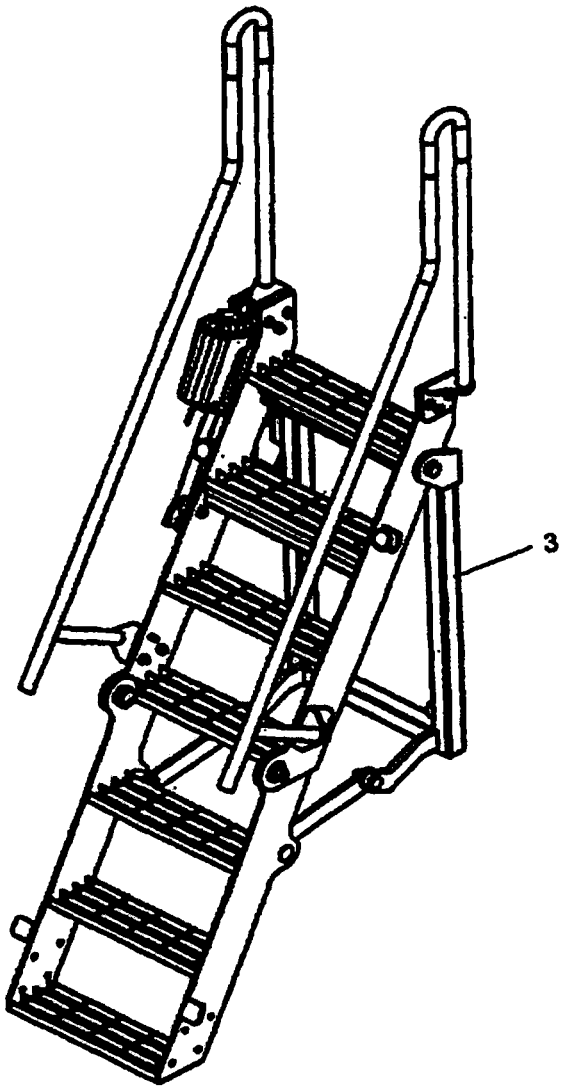
FIG. 2 shows an alternative perspective view of the access, device of FIG. 1.
Figure 3A:
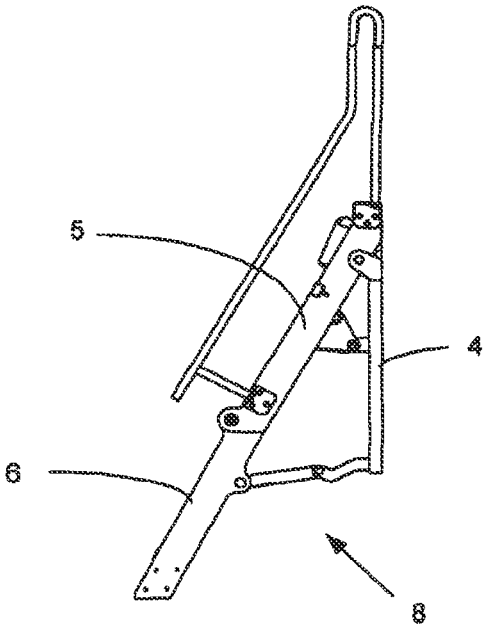
FIG. 3 illustrates, in FIGS. 3(*a*), 3(*b*) and 3(*c*), side, front and top views of the access device of FIGS. 1 and 2.
Figure 3B:
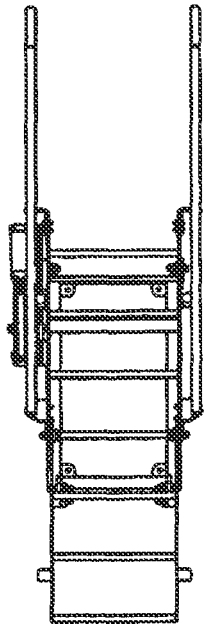
Figure 3C:
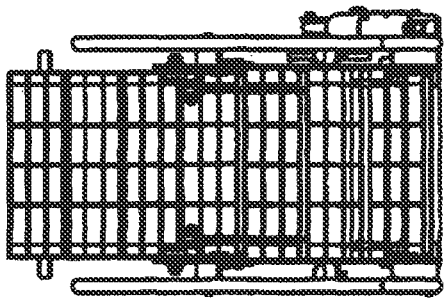

Throughout the drawings, like numerals will be used to identify similar features, except where expressly otherwise indicated.

The access device, generally designated by the numeral 1 is for providing access between a substrate surface 2, and an elevated surface 3. The device 1 includes a mounting 4, a first ladder member 5, a second ladder member 6, a drive means 7 and a guide arm 8.

Figure 4:
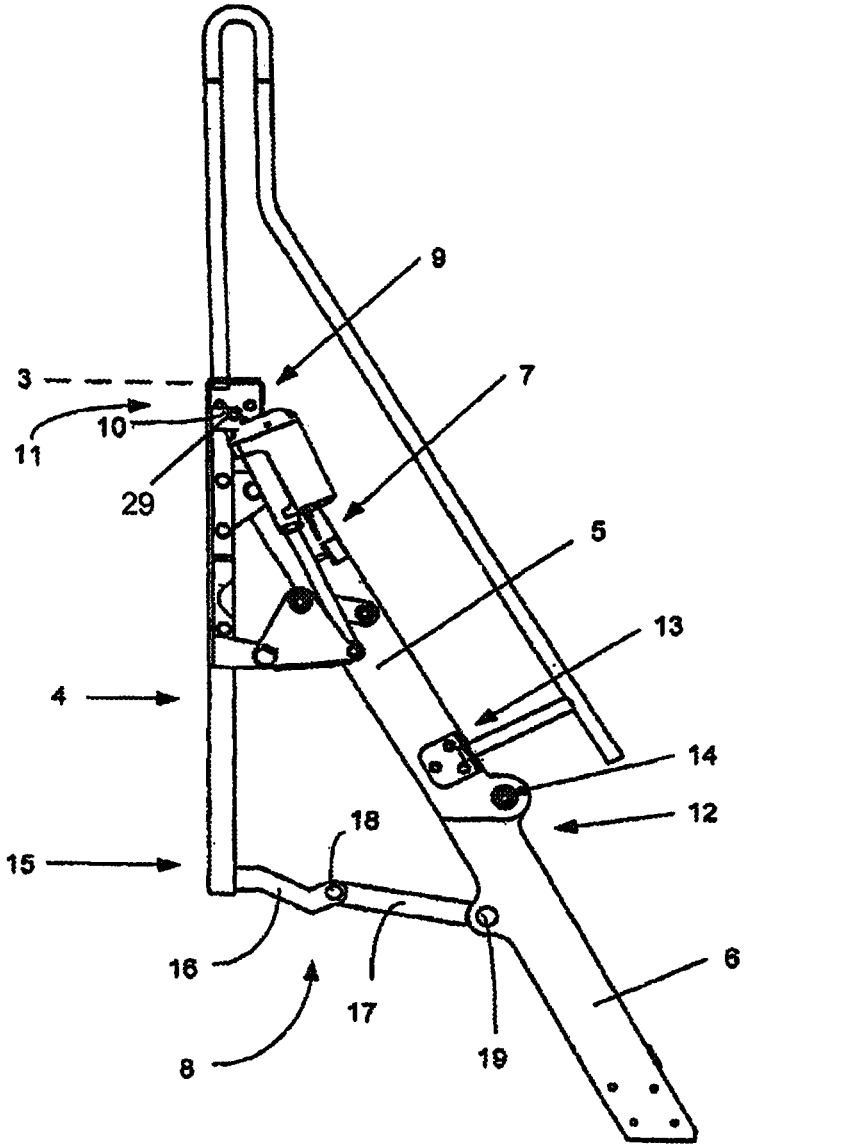
FIG. 4 illustrates a side view of the access device in the "access" position.
Figure 5:
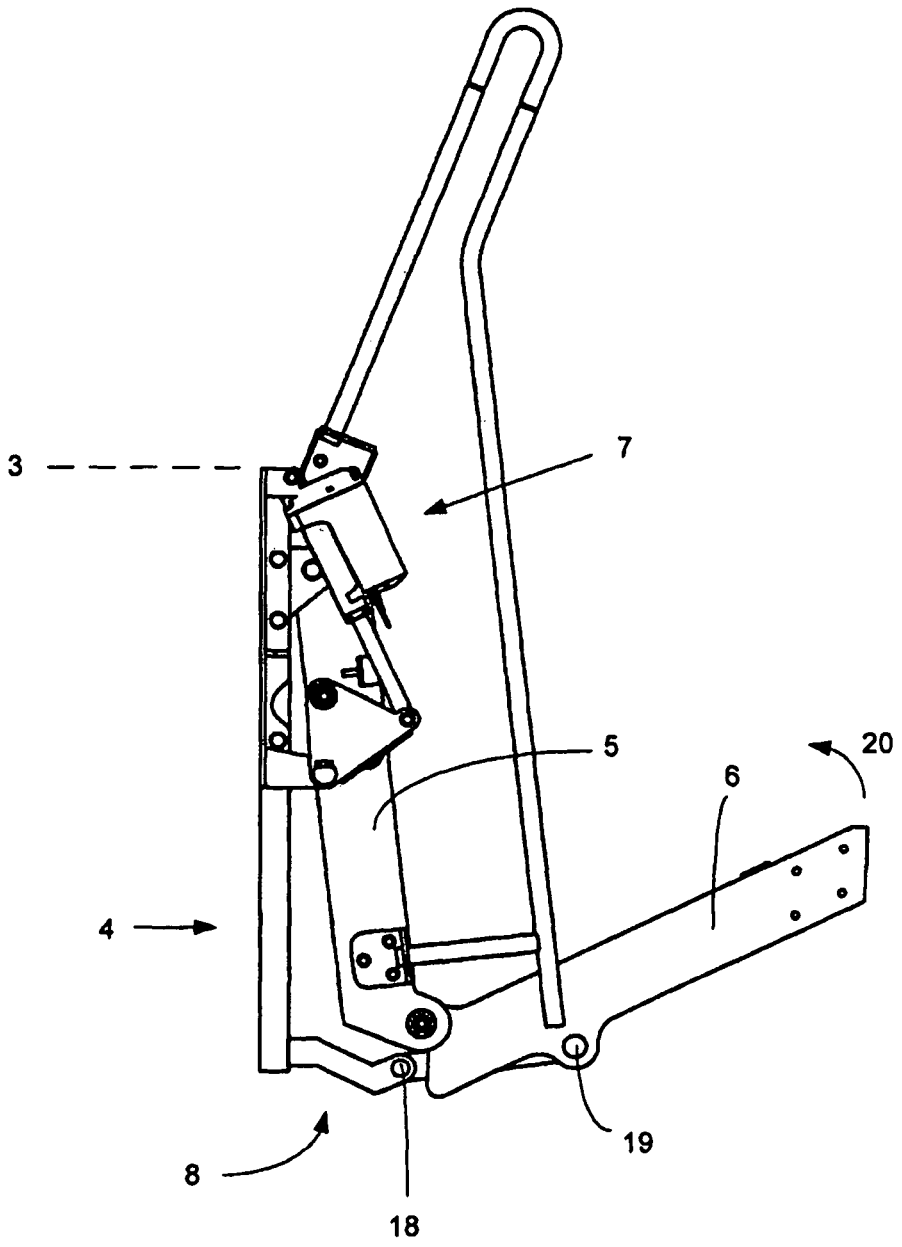
FIG. 5 illustrates a side elevational view of the access device in an "intermediate" position.
Figure 6:
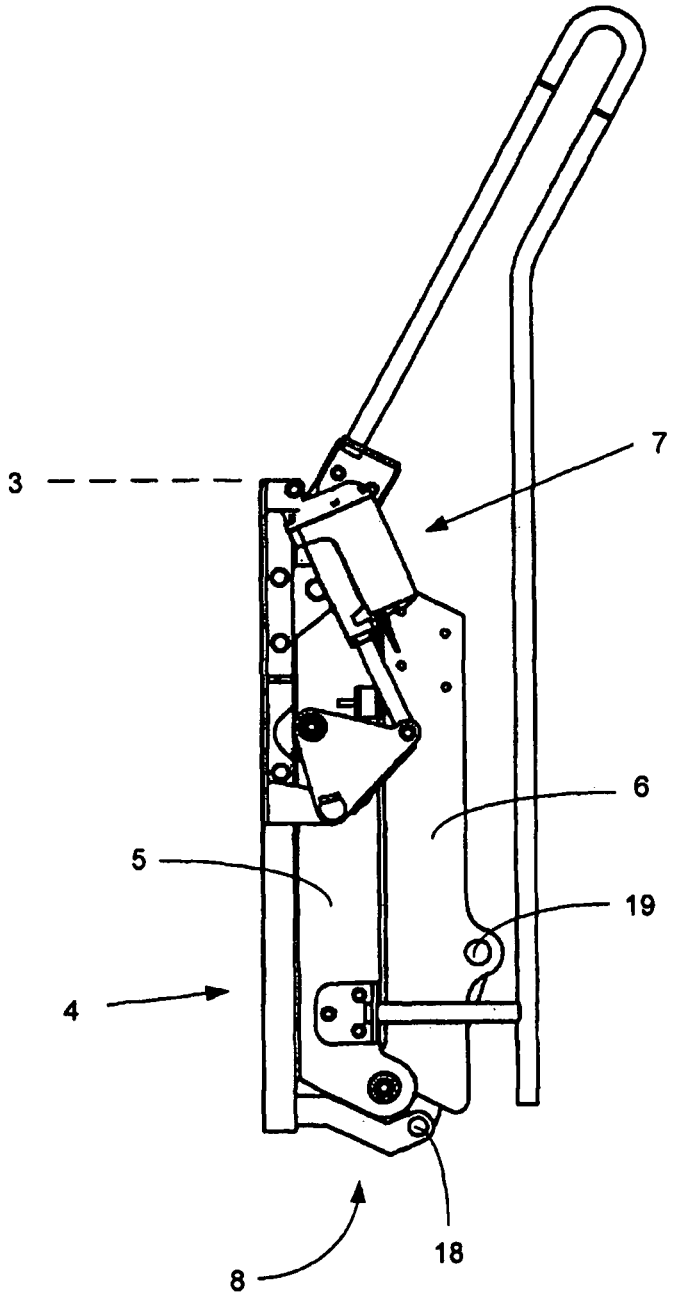
FIG. 6 illustrates a side elevational view of the access device in a "retracted" position.

The mounting 4 is for securement of the device 1 below an extremity 3 of the elevated surface. A first end 9 of the first ladder member 5 is pivotally attached at pivot point 10 to an upper end 11 of the mounting 4. The second ladder member 6 is pivotally attached at a first end 12 thereof to the second end 13 of the first ladder member 5 at pivotal connection 14. The drive means 7 is operatively connected between the mounting 4 and the first ladder member 5, as will be hereinafter described, to control the movement of the first ladder member 5 between its access position, as shown in FIG. 4 and its storage position as shown in FIG. 6. FIG. 5 illustrates an intermediate position between the access position of FIG. 4 and the storage position of FIG. 6.

The guide arm 8 is operatively connected between a lower end 15 of the mounting 4 and the second ladder member 6, to guide the movement of the second ladder member 6 as the drive means 7 moves the first ladder member 5. The guide arm 8 is shown having a first guide arm member 16 pivotally connected to a second guide arm member 17 at pivot point 18. The other end of guide arm member 17 is pivotally connected to the second ladder member 6 at pivotal connection 19.

It will therefore be understood that, upon operation of the drive means 7 by a user, the movement of the access device 1 between the access position as shown in FIG. 4 and a storage position shown in FIG. 6 may be controlled.

As shown in FIG. 4, in the access position, each of the first and second ladder members 5 and 6 are substantially coaligned and extend angularly outwardly and downwardly from the elevated surface 3. Activation of the drive means 7 by a user affects movement of the device as shown by arrow 20 through the intermediate position shown in FIG. 5 to the storage position shown in FIG. 6.

In the storage position shown in FIG. 6, each of the first and second ladder members 5 and 6 respectively are retracted in a substantially vertically disposed manner adjacent the mounting 4. In this position, the second ladder member 6 has pivoted 180° relative to the first ladder member 5, and is substantially inverted relative to the first ladder member 5, and relative to its original position.

Figure 7:
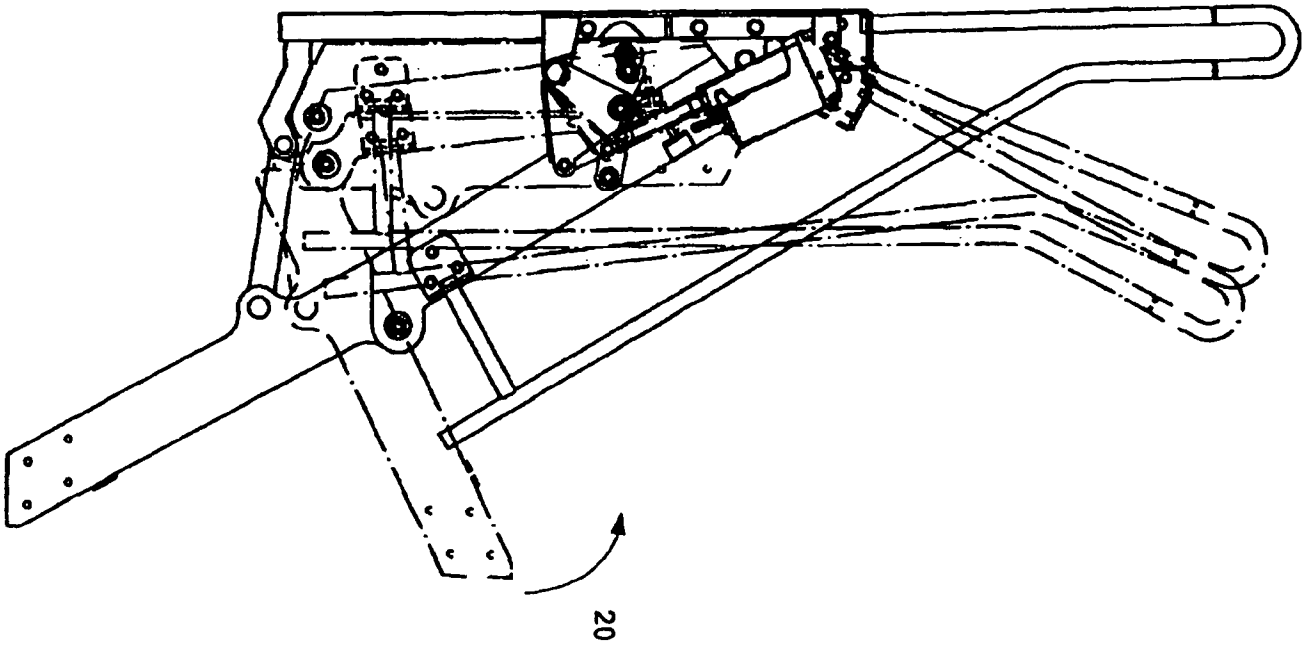
FIG. 7 illustrates the access device showing the movement between the access and retracted positions.

FIG. 7 illustrates the various positions shown in FIGS. 4, 5 and 6 in a superimposed manner.

Figure 8:
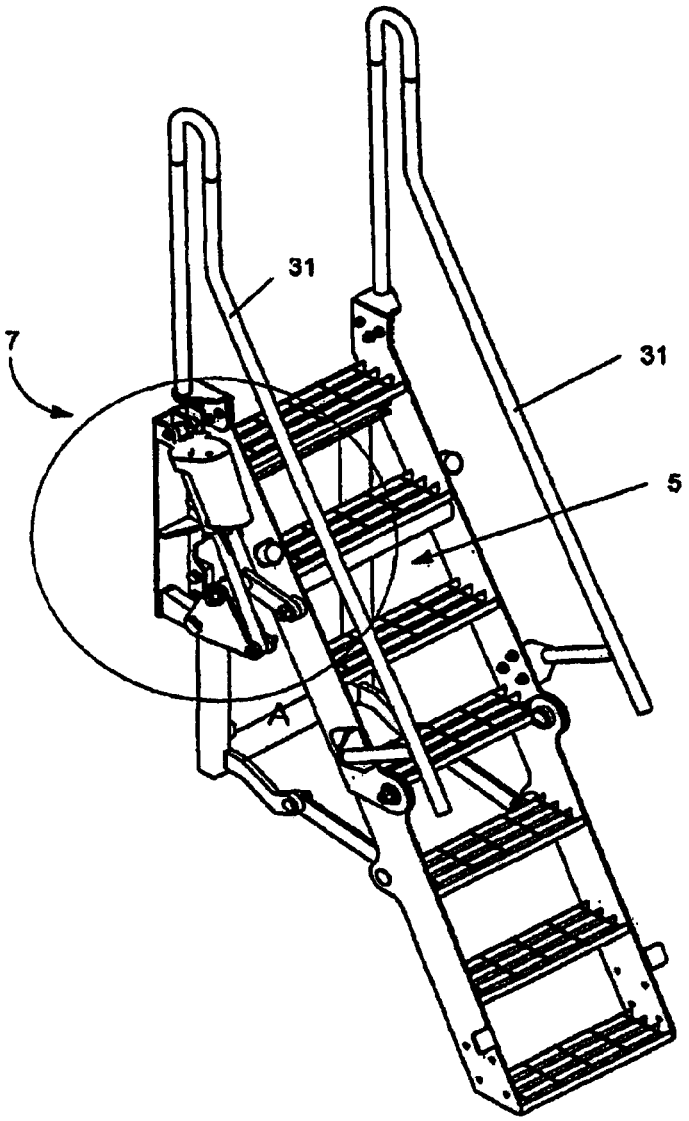
FIG. 8 illustrates a perspective view of the access device of the present invention in which the drive means is encircled; and, FIG. 9 illustrates a detailed view of the portion encircled A of FIG. 8, specifically detailing the drive means of the access device of the present invention.
Figure 9:
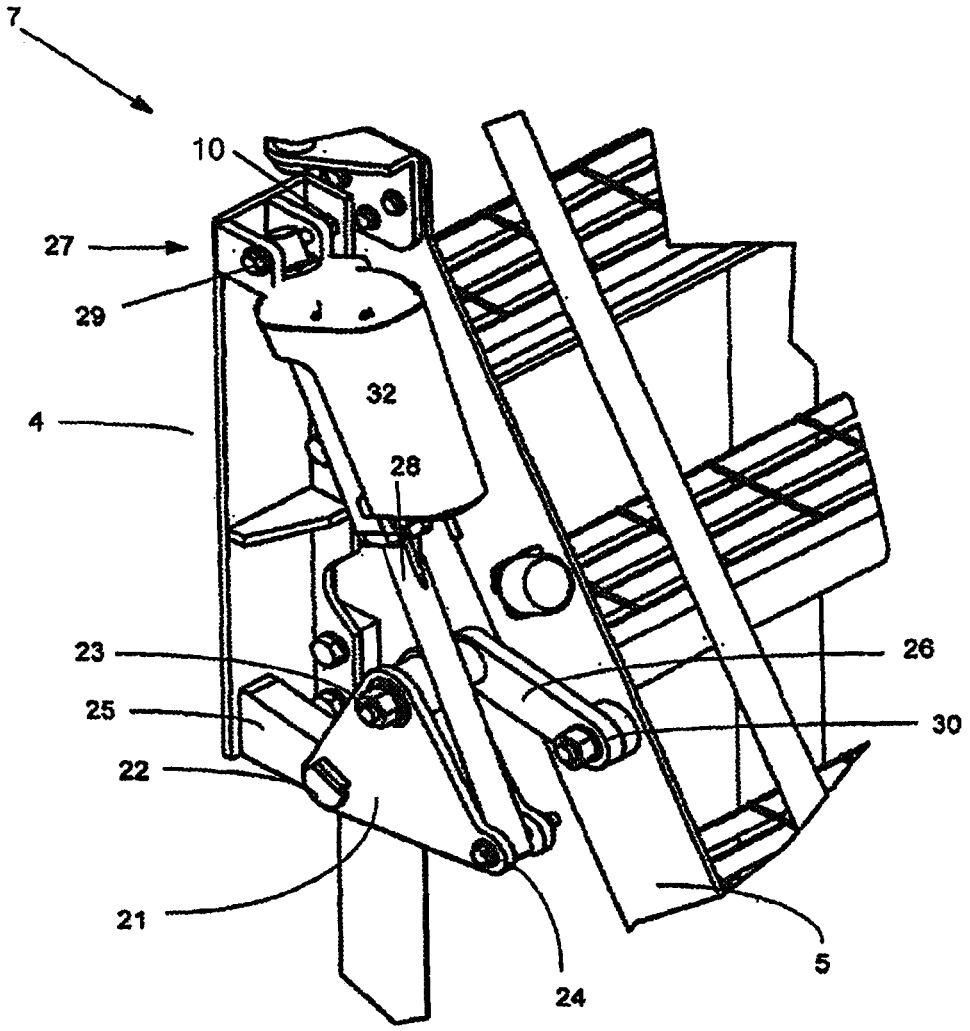

FIG. 8 illustrates a perspective view of the device with the drive means being encircled. FIG. 9 illustrates an enlarged view of the encircled portion of the drive means encircled in FIG. 8.

The drive means includes a rotatable member 21, having three pivotal connections 22, 23 and 24. The first of the connections is attached to the mounting 4 by a mounting arm 25. The second of the connections 23 is pivotally attached, at pivotal connection 30 to the first ladder member 5 by a control arm 26.

The third connector 24 is attached to the upper extremity 27 of the mounting 4 via an extendable arm arrangement 28. The other end of the extendable arm arrangement 28 connected to the upper extremity of the mounting arm is connected by pivot point 29.

Contraction or extension of the extendable arm arrangement 28 will therefore cause the rotatable member 21 to rotate about pivot point 22. As the rotatable member 21 rotates about pivot point 22, this controls movement of the first ladder member 5 as it is connected to the rotatable member 21 via the control arm 26. The control arm 26 is permitted to rotate relative to both the first ladder member 5 via pivotal connection 30 and the rotatable arm 21 via the pivotal connection 23.

Consequently, as the extendable arm 28 is extended or contracted movement of the access device 1 between the access position shown in FIG. 4 and the storage position shown in FIG. 6 is effected.

The access device further preferably includes a handrail attached to one or both sides of the access device. In the embodiment shown, a handrail 31 is connected to each side of the first ladder member 5.

The drive means 7 shown in the drawings includes a cylinder and piston arrangement 32. This drive means may be embodied as a hydraulic, pneumatic or electric cylinder. Likewise, an alternative form of motor may be used to rotate rotatable member 21.

It will therefore be appreciated by persons skilled in the art that the access device of the present invention is particularly useful for attaching to the side of a vehicle such as a mining earthmoving equipment train or other like vehicle. The access device is desired to be provided at a suitably disposed outwardly inclined position for access of the user between a substrate surface and an elevated surface of the vehicle, whilst being fully retractable on the side of the vehicle in a storage position. The access device of the present invention is adapted to be mounted to a side surface of such a vehicle in a manner such that does not intrude on any elevated surface in either its access position or storage position. It will be appreciated by persons skilled in the art that various alterations and modifications to the access device of the present invention will become apparent. All such variations and modifications should be considered to fall within the spirit and scope of the invention as will be hereinbefore described.

The invention claimed is:

1. An access device, adapted to provide access between a substrate surface and an elevated surface of a vehicle, including:

a mounting, to support said device below said elevated surface of said vehicle;

a first ladder member, a first end of which is pivotally attached to an upper end of said mounting at a pivot point;

a second ladder member, a first end of which is pivotally attached to a second end of said first ladder member at a pivotal connection;

a drive mechanism, operatively connected between said mounting and said first ladder member, to control the movement of said access device between an access position and a storage position, the drive mechanism including:

a rotatable member having three pivotal connectors spaced apart in a triangular arrangement;

a first of said connectors attached to an intermediate portion of said mounting via a mounting arm;

a second of said connector attached to an intermediate portion of said first ladder member via a control arm; and a third of said connectors attached to an upper portion of said mounting via an extendable arm; and a guide arm, including first and second pivotally connected guide arm members, operatively connected between a lower end of said mounting and an intermediate portion of said second ladder member, to guide the movement of said second ladder member as said drive mechanism moves said first ladder member, whereby user operation of said drive mechanism controls the extension or contraction of said extendable arm to thereby control the operation of said access device between an access position and a storage position, in which, in said access position, each of said first and second ladder members are substantially coaligned and extend angularly outwardly and downwardly from said elevated surface but without contacting said substrate surface, and wherein the extendable arm is in an extended state in the access position;

in said storage position, each of said first and second ladder members are retracted in a substantially vertically disposed manner adjacent to said mounting and below said elevated surface, said second ladder member being substantially inverted relative to said first ladder member, wherein the extendable arm is in a contracted state in the storage position, and wherein in the extended state the extendable arm is longer than when in the contracted state, and wherein the pivotal connection is disposed below the pivot point in the access and the storage positions.

2. An access device as claimed in claim 1, further including a handrail attached to at least one side of said first ladder member.

3. Access device as claimed in claim 1, wherein said drive mechanism includes a hydraulic, pneumatic or electric cylinder.

4. An access device as claimed in claim 1, wherein, in said access position, said ladder members are each disposed at between 60° and 75°, relative to said substrate surface.

* * * * *